US006267403B1

(12) United States Patent
Bossin et al.

(10) Patent No.: US 6,267,403 B1
(45) **Date of Patent: *Jul. 31, 2001**

(54) SHOE/BINDING ASSEMBLY FOR SNOW GLIDING BOARD

(75) Inventors: Rodolphe Bossin, Grenoble; Jean Bauvois, Villard de Lans, both of (FR)

(73) Assignee: Skis Rossignol S.A., Voiron (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/948,740

(22) Filed: Oct. 10, 1997

(30) Foreign Application Priority Data

Oct. 14, 1996 (FR) ..... 96 12772

(51) Int. Cl.[7] ..... A63C 9/20
(52) U.S. Cl. ..... 280/625; 280/14.22; 280/634
(58) Field of Search ..... 280/615, 617, 280/623, 624, 625, 626, 631, 632, 634, 635, 14.21, 14.22, 14.24

(56) References Cited

U.S. PATENT DOCUMENTS

| | | | | |
|---|---|---|---|---|
| 1,922,955 | * | 8/1933 | Jensen | 280/615 |
| 3,905,612 | * | 9/1975 | Kjellstrom | 280/635 |
| 3,955,825 | * | 5/1976 | Kubelka et al. | 280/634 |
| 4,177,584 | * | 12/1979 | Beyl | 280/613 |
| 4,403,789 | * | 9/1983 | Hickey | 280/614 |
| 4,632,419 | * | 12/1986 | Zoor | 280/614 |
| 4,909,531 | * | 3/1990 | Graillat | 280/615 |
| 5,520,406 | * | 5/1996 | Anderson et al. | 280/624 |
| 5,556,123 | | 9/1996 | Fournier | 280/14.2 |
| 5,595,396 | * | 1/1997 | Bourdeau | 280/613 |
| 5,660,410 | * | 8/1997 | Alden | 280/14.2 |
| 5,727,797 | * | 3/1998 | Bowles | 280/14.2 |
| 5,901,971 | * | 5/1999 | Eaton | 280/624 |
| 5,954,358 | * | 9/1999 | Bejean et al. | 280/14.24 |

FOREIGN PATENT DOCUMENTS

| | | | | |
|---|---|---|---|---|
| 682133 | | 7/1993 | (CH) . | |
| 8902125 | | 6/1989 | (DE) . | |
| 4311630 | * | 8/1994 | (DE) | 280/14.2 |
| 270175 | * | 6/1988 | (EP) | 280/14.2 |
| 2626189 | * | 7/1989 | (FR) | 280/14.2 |
| 2733671 | | 11/1996 | (FR) . | |
| 9603185 | | 2/1996 | (WO) . | |
| 9617660 | | 6/1996 | (WO) . | |

* cited by examiner

*Primary Examiner*—Frank Vanaman
(74) *Attorney, Agent, or Firm*—Wall Marjama & Bilinski

(57) ABSTRACT

A shoe/binding assembly for a gliding board allowing the user's foot to be secured temporarily to said board at a plurality of contact points which, on the binding, consist of attachment means intended to interact with complementary attachment means which are located on the shoe at the front and rear of the sole, wherein at least one of the contact points has a plurality of positions for locking of the attachment means of the shoe by those of the binding, intended to prohibit any movement of the shoe upward and to make it possible to change automatically from one locking position to the next in the downward direction of the shoe, under the effect of the user's weight.

29 Claims, 7 Drawing Sheets

SHOE/BINDING ASSEMBLY FOR SNOW GLIDING BOARD

TECHNICAL FIELD

The invention relates to an item of equipment for the practice of snowboarding. More precisely, the invention relates to a binding and the complementary shoe which make it possible, on the one hand, for the shoe to be engaged automatically and, on the other hand, for the shoe to be secured to the snowboard, irrespective of the depth of snow lying in between the shoe and the board.

PRIOR ART

As is known, there are several techniques for the practice of snowboarding. Mention may, in particular, be made of the first form termed "alpine gliding" which is practiced on ski trails of traditional appearance, on prepared snow.

A second form termed "freestyle" is also known, which takes place on particular pistes forming semi-cylindrical valleys, generally artificially hollowed, and commonly referred to by the expression "halfpipe". Lastly, it is also known that snowboarding is practiced on powdery snow slopes.

It is quite clear that each of these modes of use requires a number of properties in the articulation between the user's leg and the board, in particular as regards forward flexing and rearward support.

Chronologically, three different types of shoes have been proposed, to be combined with corresponding bindings which are also different.

Firstly, the first shoes used for the practice of snowboarding were downhill ski boots, that is to say boots having a rigid shell allowing limited forward inclination of the leg. These shoes are fitted to bindings having elements, namely a fixed stirrup piece into which the heel of the shoe is inserted, and an articulated front stop in the form of a stirrup piece, provided with a buckle and capable of engaging the front portion of the toe of the shoe. Quite clearly, this type of shoe proves to be too rigid, in particular in disciplines requiring large articulations of the tibia relative to the foot, such as the technique practiced in "halfpipes".

This type of shoe also proves to be poorly suited to walking because it is too rigid.

Subsequently, the use of flexible shoes was proposed, these more generally having the form of a boot which is advantageously practical for walking. Unfortunately, the existence of this flexibility made it necessary to develop the bindings in order to allow them to cater for rearward support.

Bindings were thus developed having a platform on which the shoe is fixed by several straps and which have a rigid back plate fixed substantially perpendicularly to the board and rising toward the calf. Unfortunately, the use of straps requires adjustment operations every time the shoes are engaged on the board, and it is well known that this takes place frequently in snowboarding, especially when the user reaches a flat region or when he needs to use a ski lift.

Another type of binding is also known which employs retractable components, secured to the board, which interact with complementary attachment elements secured to the sole of the shoe. In this case, the shoes have a flexible base and include a number of reinforcements in the regions needed for taking up rearward forces and transferring feel from the board to the foot. More precisely, in Patent Application FR 2,733,671, the Applicant has described a shoe which has a frame combining a rigid sole and a back spoiler which is also rigid. Unfortunately, although satisfactory, this solution is substantially equivalent to a rigid shoe and entails discomfort when walking, as well as deadening of the feel. The sensitivity of architectures of this type to mechanical play is also to be noted.

Lastly, another type of binding is known, which is illustrated in document WO 96/17660 and is essentially composed of a plate which is mounted on the board and whose rear part comprises a rigid spoiler intended to surround the bottom rear part of the leg and to take up rearward forces. The shoe is secured to this binding at two points, namely, on the one hand, at the spoiler by means of a catch which latches a protruding portion of the shoe and, on the other hand, at the front, under the sole by means of a transverse groove in which a corresponding transverse axle of the binding is housed. Unfortunately, the operation of engaging the shoe is carried out "blind" because the attachment elements are located under the shoe and do not allow the user to see the attachment proper. More precisely, when the user fits his shoe into the binding, there is a risk that the toe of his shoe will abut against the board and that attachment to the transverse axle will not take place.

Further, the use of a transverse axle interacting with an open groove located on the shoe necessarily leads to the shoe having a degree of lateral play inside the binding. It is therefore not possible to use different shoe sizes with this binding, without entailing the risk of the shoe becoming loose relative to the board.

Finally, in order to be capable of functioning, this binding requires that the sole of the user's shoe be free of a wedge of packed snow, or it may not be possible for the initial engagement of the binding to take place.

One of the problems which the invention therefore proposes to solve is to provide a snowboard binding which makes it possible to fit a shoe which is essentially flexible, and therefore comfortable for walking, using an automatic shoe engagement operation during which the user can check that his shoe is fitted and attached correctly.

One of the other problems which the invention proposes to solve is to make it possible to fit a large number of different shoe sizes into a snowboard binding.

A further problem resides in how the binding functions when there is a wedge of snow present under the sole of the shoe, in view of the fact that this packed snow may later become removed, that is to say the initial position of the shoe relative to the binding may become altered.

SUMMARY OF THE INVENTION

The invention therefore relates to a shoe/binding assembly for a snow gliding board, and in particular for a snowboard, allowing the shoe to be secured temporarily to said board at a plurality of contact attachment points which, on the binding, consist of attachment means intended to interact with complementary attachment means which are located on the shoe at the front and rear of the sole.

This shoe/binding assembly for a snow gliding board is one wherein at least one of the attachment points has a plurality of positions for locking of the attachment means of the shoe by those of the binding, so as to prohibit any movement of the shoe upward and to make it possible to change automatically from one locking position to the next in the downward direction of the shoe, under the effect of the user's weight.

In other words, the shoe is equipped with characteristic elements which make it possible to attach to the binding while ensuring permanent contact of the various points of interaction of the shoe with the binding. In this way, when the user engages his shoe with the snowboard, the characteristic attachment point is locked in the optimum position, thus avoiding any play between the shoe and the binding.

Thus, for example, the sole of the shoe often has a wedge of packed snow which becomes formed during walking and lies in between the sole of the shoe and the snowboard. The characteristic elements of the invention are constructed in such a way that, as the packed snow becomes removed, the position of the shoe is adapted in order to avoid the occurrence of any vertical play.

In practice, the attachment means which have a plurality of locking positions are located either at the front or at the rear of the shoe and the binding.

In one embodiment, the attachment means consist, on the one hand, of a catch and, on the other hand, of a notched region into which the catch locks, the catch and the notched region being located either on the shoe and on the binding, or vice versa.

In a practical embodiment, the catch is articulated either onto the shoe or onto the binding and is associated with a return element which presses it into contact with the notched region lying opposite.

In an alternative embodiment, it is the notched region which is articulated and associated with a return element which presses it against the fixed catch.

Advantageously, in practice, the notched region consists of a plurality of teeth which are oriented upward and are connected by inclined portions which allow the catch to move upward.

Thus, the profile of these notches is such that, as the wedge of snow becomes removed, for example, the catch moves automatically to the upper notch in order to adapt the position of the sole of the shoe to the new height of the wedge of snow.

In practice, the binding includes a plate which is intended to accommodate the sole of the shoe and whose upper face has inclined slopes which are intended to make it easier to remove the wedge of snow. Thus, by virtue of the user's weight and the various forces which he generates during the practice of snowboarding, the wedge of snow tends to become packed down, then, owing to the inclined slopes, to be removed. The characteristic device of the invention then allows the shoe to re-adjust relative to the binding without the occurrence of play.

In a practical embodiment, the binding has a rear frame rising over the lower leg, said frame consisting of a spoiler which is mounted so as to be articulated on a stirrup piece which is itself secured to the snowboard.

This solves the problem of the snowboard being bulky, in particular for its transport and its storage, since the user folds down the spoiler when he disengages his shoe from the board.

In order to provide forward support, and to avoid the spoiler folding when the leg flexes forward, the spoiler has a lever for locking it in position on the frame.

In practice, in order to avoid any unintentional retraction of the locking catch, the locking lever is articulated with respect to the spoiler at the axle for articulation of said catch relative to the spoiler.

Advantageously, the lever for locking the spoiler in position can be adjusted in order to fix the inclination of the spoiler relative to the stirrup piece according to the user's choice.

As already stated, the invention also proposes to solve the problem of automatic shoe engagement. To this end, two of the attachment points are located on each side of the sole, level with the metatarsophalangeal joint, the third point being located on the rear frame.

In this way, when they are in the locked position, the binding and the shoe constitute a hyperstatic system which, by itself, ensures optimum holding of the shoe.

As already stated, the characteristic attachment means of the invention make it possible to lock the position of the shoe with respect to the binding, irrespective of the variation in the thickness of the wedge of snow. In this way, the system automatically remains in a hyperstatic configuration.

Further, the front attachment regions are clearly visible and allow the user to check that the corresponding means of the shoe are properly clear until locking is complete.

In practice, the front attachment means are hooks open at the rear, the complementary means of the shoe being pins which engage in each of the hooks.

The invention also seeks to solve the problem of adapting this binding to different shoe dimensions corresponding to different sizes.

Thus, the lateral attachment means, located for example at the front of the sole, can be adjusted in position in the transverse and longitudinal directions, so as to adapt to the width and length of the shoe.

Additionally, the spoiler can be adjusted in position in the longitudinal direction, so as to adapt to the length of the shoe.

In a preferred form, the binding has means for coupling the positional adjustment of the lateral attachment means and of the spoiler.

In other words, when the position of the spoiler is modified, in view of the size and, more precisely, the length of the shoe, the lateral attachment means are shifted so that they adapt to the width of the shoe, level with the metatarsophalangeal joint.

BRIEF DESCRIPTION OF THE DRAWINGS

The way in which the invention is embodied, as well as the advantages which result therefrom, will emerge clearly from the description of the following embodiments, supported by the appended figures, in which.

EMBODIMENT OF THE INVENTION

As already stated, the invention relates to a snowboard binding and to the corresponding shoe.

Figure 1:
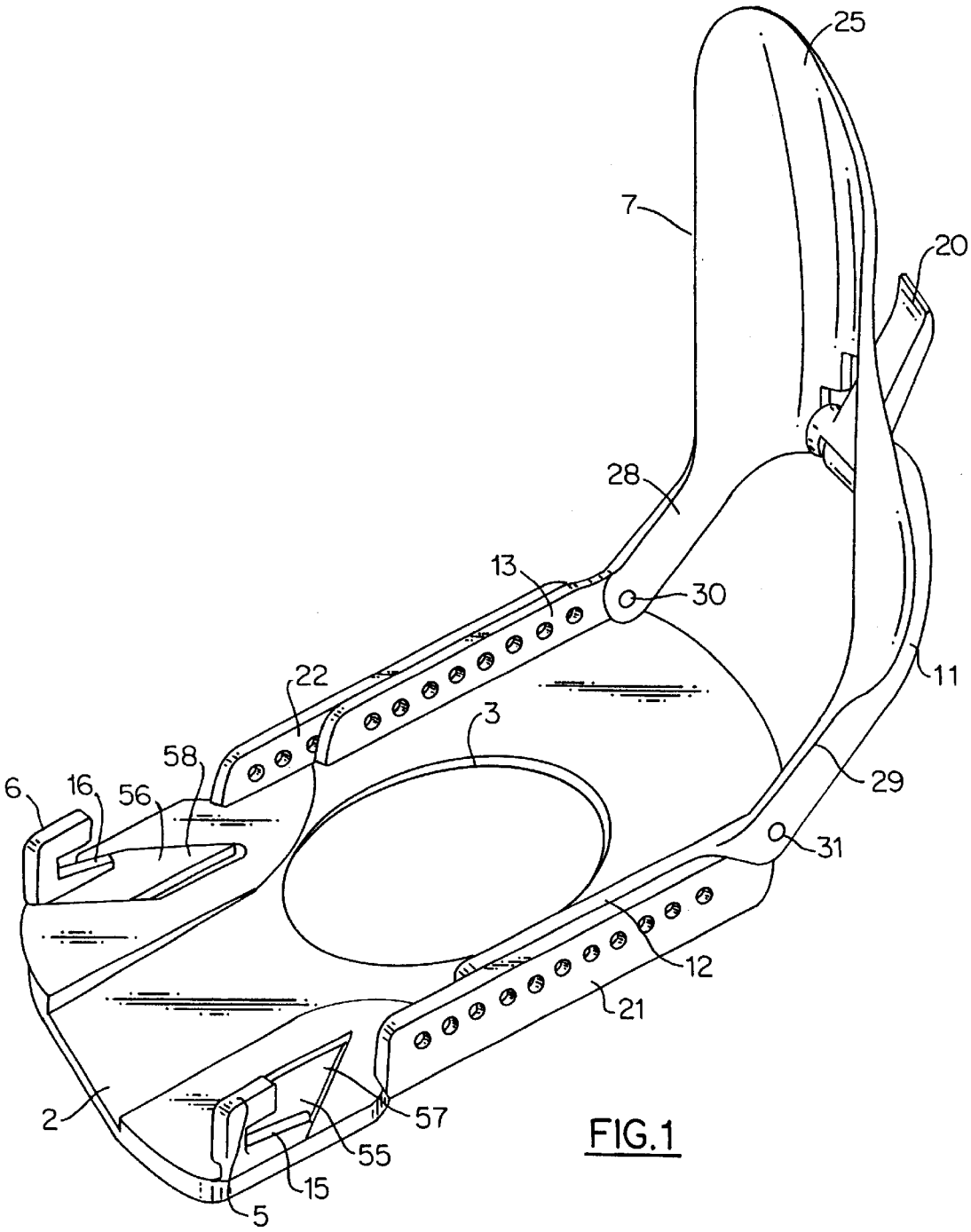
FIG. 1 is an outline perspective view of a binding according to the invention.

Thus, as can be seen in FIG. 1, the binding (1) according to the invention has a plate (2) intended to be secured to the board proper.

Advantageously, this plate may have a central orifice (3) making it easier to orientate the binding relative to the board proper.

In the example illustrated in FIG. 1, the shoe is attached at three points, namely two points (5, 6) which are located at the front of the binding, and one point at the rear of the leg.

It should be pointed out beforehand that the invention is not limited to the forms represented in these figures but that, as already stated, it covers a number of architectural variants.

Thus, the invention is shown in its optimum form of a hyperstatic system formed by three attachment points, but the invention also encompasses systems which use only two attachment points, one of which has a plurality of locking positions.

Further, the two lateral points could be located at the rear, level with the heel, while the point located in the longitudinal mid-plane could interact with the front of the shoe.

Moreover, although the figures illustrate a binding whose rear part consists of a frame (7) rising over the lower leg, it is quite clear that the invention also encompasses simpler embodiments in which the frame is replaced by a more rudimentary structure, so long as the spirit of the invention is respected, that is to say one of the attachment points has a plurality of locking positions.

More precisely, the attachment points (5, 6) located on each side of the shoe are in the form of hooks whose opening (15, 16) is oriented toward the rear. These hooks are intended to receive attachment pins (not shown) which are arranged laterally on the sole of the shoe. By virtue of their off-centered position, these hooks (5, 6) can be seen throughout the shoe engagement operation, which makes it easier to monitor and check that the shoe is being engaged correctly.

At the rear part, the shoe is attached level with the frame (7) by a locking lever (20) which interacts with a characteristic portion of the shoe. More precisely, the frame (7) consists at the lower part of a stirrup piece (11) which passes over the calcaneus and whose free ends are extended by two straight segments (12, 13) which interact with complementary rails (21, 22) of the plate (2).

At the top, the frame (7) is composed of a spoiler or back plate (25) whose bottom ends have branches (28, 29) parallel to the stirrup piece (11). An articulation axle (30, 31) is arranged at the end of these branches (28, 29). In this way, when the snowboard is carried, the spoiler (25) of the binding (1) can be folded down to save space.

Figure 2:
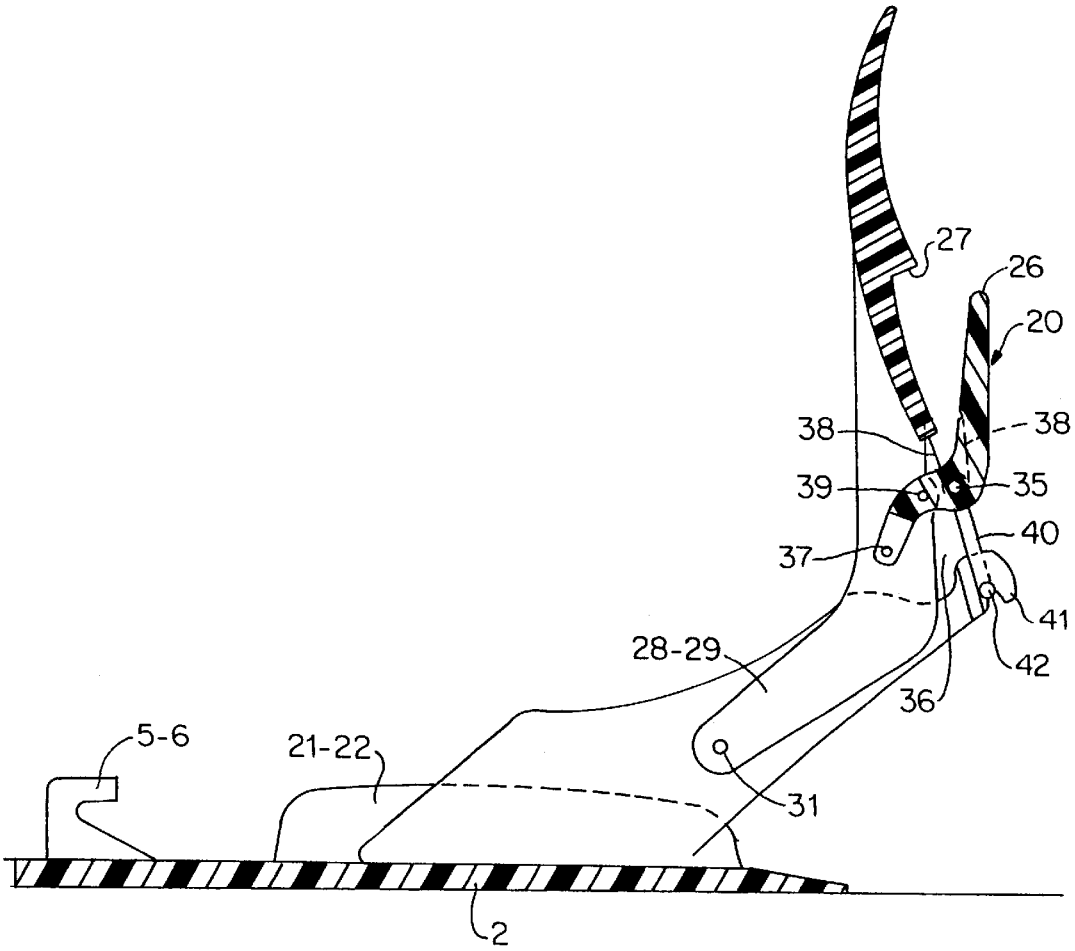
FIG. 2 is a view in longitudinal section of the binding in FIG. 1.

More precisely, as is seen in FIG. 2, the spoilers have a locking lever (20) which is articulated with respect to the spoiler at an articulation axle (35). This locking lever (20) moves inside an opening (36) which is made for this purpose in the back plate (25). This locking lever (20) has an axle (37) intended to come to face the shoe (50). This axle (37) is kept in an emergent position by virtue of the action of a return element, for example a spring (38), mounted level with the transverse articulation axle (39).

Additionally, the spoiler (25) is coupled to the stirrup piece (11) by means of a locking lever (40). This lever (40) is mounted on the spoiler level with the articulation axle (35) of the locking lever (20) and extends in the direction of the stirrup piece (11), or more precisely that portion (41) of the stirrup piece (11) which lies in the plane of the longitudinal mid-axis. This lever (40) has the shape of a buckle (42) which can engage the portion (41) of the stirrup piece (11).

In this way, articulated movement of the spoiler with respect to the binding about the axles (30, 31) is blocked, which prevents any unintentional tilting of the spoiler (25) when the leg flexes forward. The lever (40) is articulated onto the same axle (35) as the locking lever (20), in order to avoid any influence of the forward flexing on the position of said lever (20).

Figure 7:
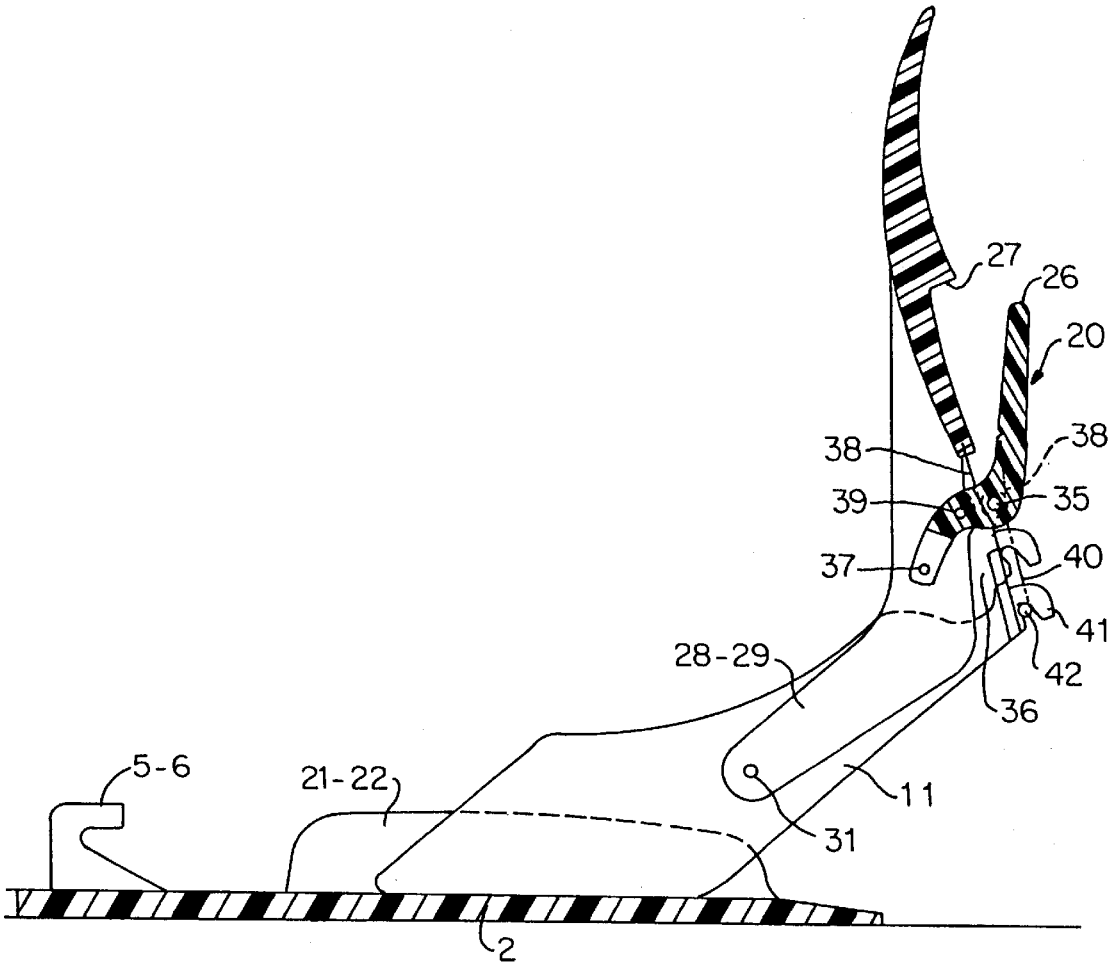
FIG. 7 is a view in longitudinal section of an alternative embodiment of a binding according to the invention.

In an alternative embodiment (FIG. 7), the stirrup piece (11) has a plurality of grooves which are equivalent to the portion (41) in FIG. 2, which makes it possible to adjust the position and, more precisely, the inclination of the spoiler (25) with respect to the stirrup piece.

Figure 3:
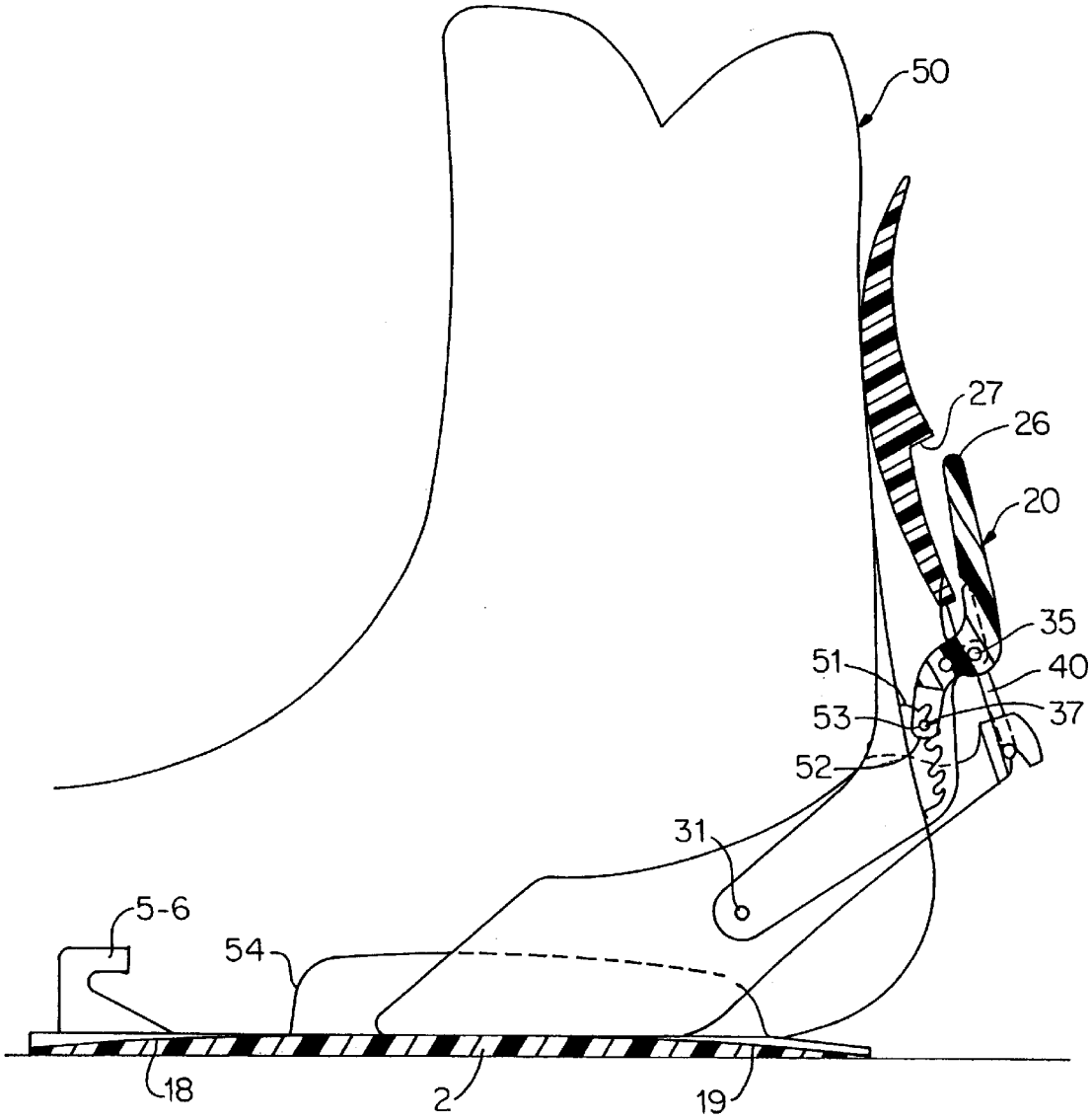
FIG. 3 is a view in longitudinal section of the binding, in which a shoe according to the invention is fitted.

As can be seen in FIG. 3, the mechanism described above is intended to interact with a fraction of the shoe (50). More precisely, this shoe (50) has a notched region (51) level with the calcaneus. This notched region has a plurality of notches (52) delimiting housings (53) inside which the axle (37) of the lever (20) can be inserted. The orientation of the various notches (52) and the axle (37) of the complementary lever is such that it is impossible for the shoe to move upward unless the axle (37) of the locking lever (20) is retracted by making the upper part (26) of said lever (20) penetrate the housing (27) of the spoiler. Further, the shape of each of the notches and of the housings permits snap-engagement down to the lowest position accessible to the sole (54). In this way, on the one hand, shoe engagement takes place automatically without the user having to lock his shoe in position and, on the other hand, the binding is not sensitive to the thickness of the wedge of snow present between the shoe (50) and the plate (2).

Figure 4:
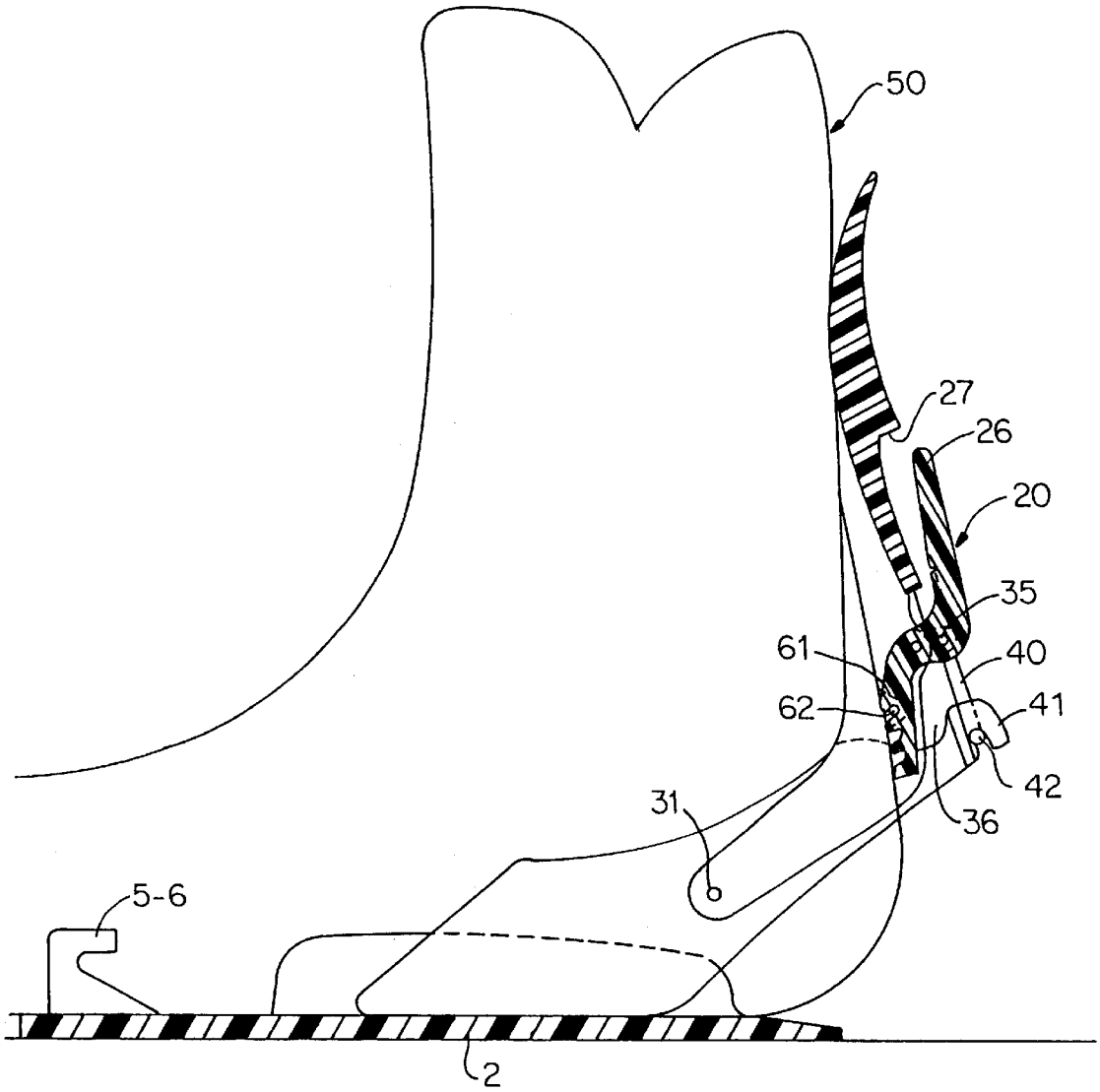
FIG. 4 is a view in longitudinal section of an alternative embodiment, showing a binding in which a shoe according to the invention is fitted.

As can be seen in FIG. 4, and as already mentioned, the relative position of the locking elements may be different. Thus, for example, the notched region (61) may be mounted so as to be articulated onto the rear frame (7), while the fixed transverse axle (62), acting as a pin, may itself be secured to the shoe (50).

As already stated, it will be straightforward for the person skilled in the art to transpose the mechanism described at the rear of the binding to the front of the shoe.

Further, the invention also encompasses a variant (not shown) in which the notched region is mounted on the shoe and is articulated with respect thereto.

Further, the upper face of the plate (2) has forward (18) and rear (19) sloping surfaces (see FIG. 3), which are respectively inclined toward the front and toward the rear, so that the snowboarder's weight causes the wedge of snow to be removed in the direction of the slope (18, 19). As the wedge of snow becomes crushed, and removed, the sole (54) moves closer to the plate (2). According to an essential characteristic of the invention, the notched region (51) becomes shifted with respect to the locking lever (20) and, if the difference in thickness of the wedge of snow is sufficient, the axle (37) can move over an additional notch (52) to reach a higher housing (53).

According to another important characteristic of the invention, the binding has adjustment means which make it possible to adapt to different shoe sizes.

Thus, as can be seen in FIG. 1, the straight segments (12, 13) of the stirrup piece (11) have a plurality of holes made through their entire thickness, while the rails (21, 22) of the plate (2) have similar holes. In this way, the longitudinal position of the spoiler can be finely adjusted, according to the size, or more precisely the length, of the shoe.

Additionally, the attachment means (5, 6) located at the front of the binding can also be adjusted in transverse position.

In the improved version in FIG. 1, these hooks (5, 6) are mounted so that they slide in the plate (2), and their base (55, 56) can move in a slot (57, 58) which is provided for this purpose in the plate (2). Positional locking means are provided in order to hold these hooks (5, 6). The orientation of the slots (57, 58), typically by an angle of 45°, makes it possible to adjust not only in width but also in the longitudinal direction.

Figure 5:
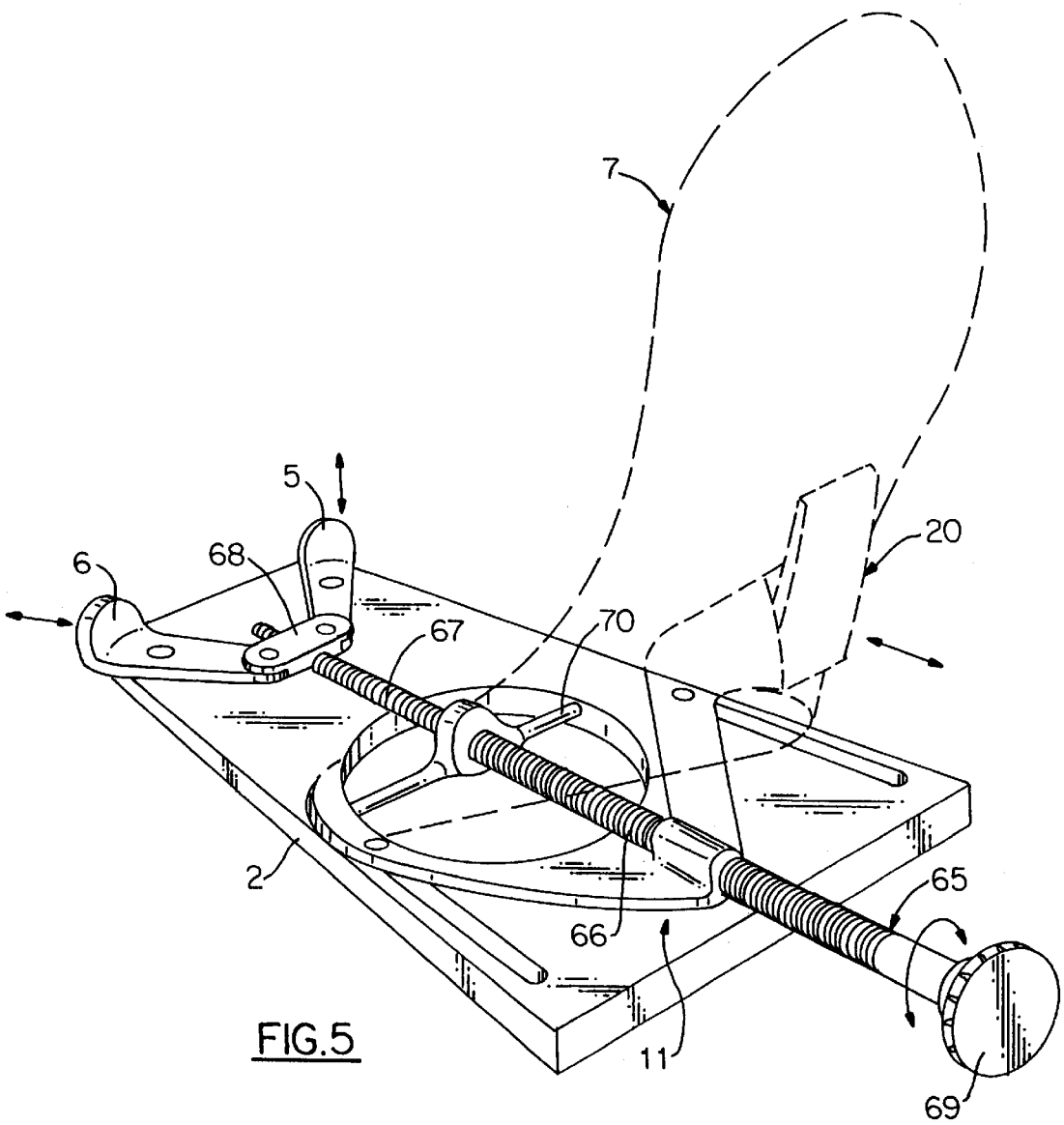
FIG. 5 is an outline perspective view of an alternative embodiment, showing the coupling of the means for adjusting the binding according to the shoe size.
Figure 6:
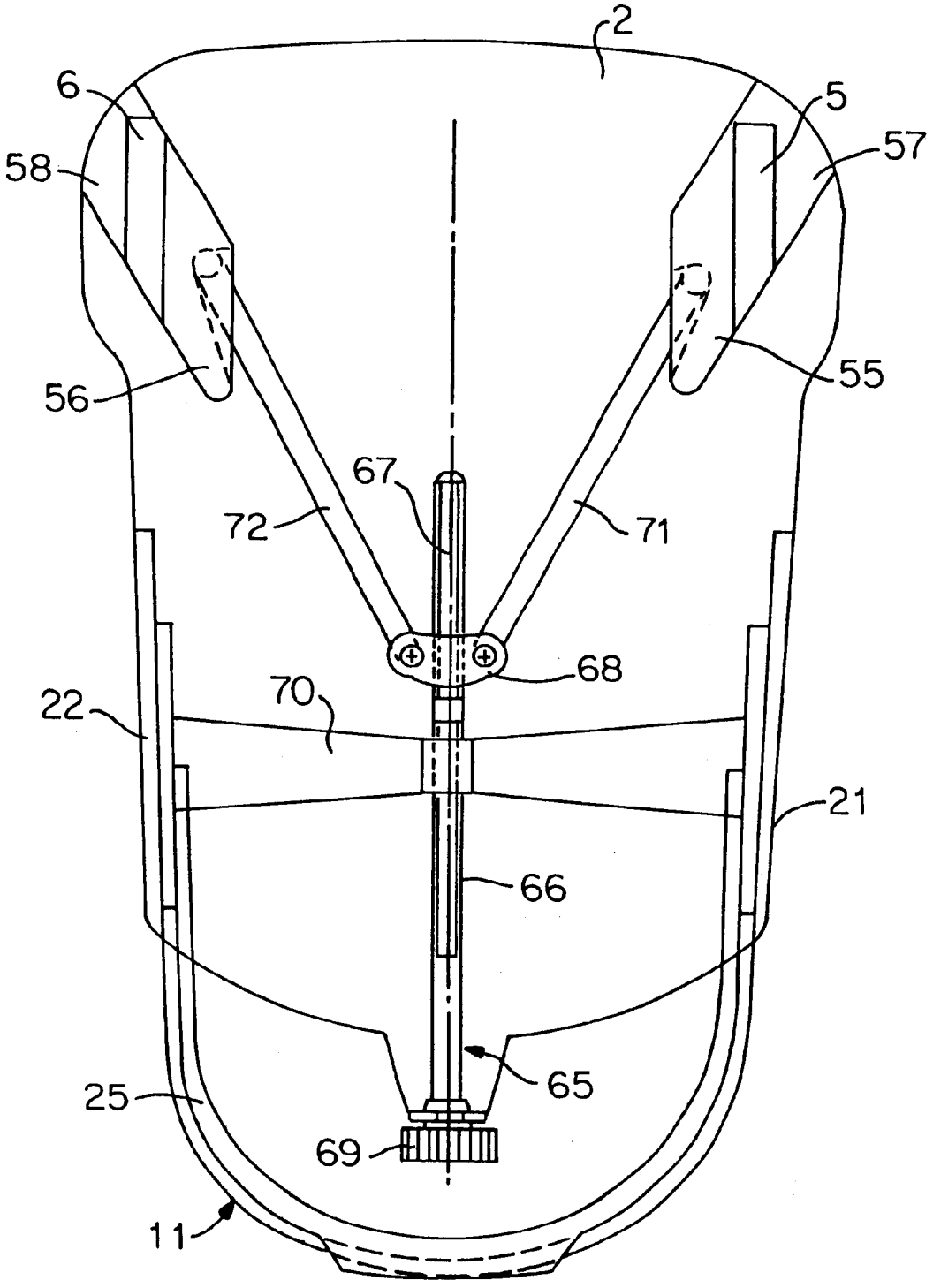
FIG. 6 is a plan view of an alternative embodiment of said coupling means.

In the improved form illustrated in FIG. 5, the stirrup piece (11) is equipped with coupling means which cause the hooks (5, 6) to move when the stirrup piece (11) is moved back.

More precisely, these coupling means consist of a longitudinal axle which interacts simultaneously with the stirrup piece (11) and the hooks (5,6). This longitudinal axle consists of a threaded rod (65) having reverse screw threads, one of the screw threads (66) being located level with the region where the rod (65) passes through the stirrup piece (11), and the opposite screw thread (67) being located level with a joint (68) which joins the hooks (5, 6). This threaded rod (65) advantageously has a knob (69) to make it easier to rotate manually. Thus, when the user desires to adapt the position of the various attachment means, he turns the knob (69) in one direction which, for example, causes the stirrup piece (11) to move back and, conversely, causes the joint (68) joining the hooks (5, 6) to move forward.

In order to make it easier to guide the threaded rod, the plate (2) has an additional element (70) located in the central region of the plate (2).

Advantageously, the hooks (5, 6) and, more exactly, their bases (55, 56) are joined to the joint (68) by means of two arms (71, 72) which pivot relative to the joint (68) and relative to the bases of the hooks, so as to allow the hooks to slide in the slots (57, 58).

The above description shows that the binding, and the associated shoe according to the invention, have a number of advantages over the prior art, namely:

elimination of any play between the shoe and the binding, since they together constitute a hyperstatic system;

the possibility of engaging the shoe in the binding automatically, while being able to check the engagement of the attachment means visually;

the possibility of precisely adjusting the position of the shoe attachment points of the binding, irrespective of the shoe size, that is to say width and length;

the possibility of securing the shoe to the binding irrespective of the thickness of the wedge of snow located between the sole and the binding;

dynamic adaptation of the rear attachment point as the thickness of the wedge of snow changes during the practice of snowboarding.

What is claimed is:

1. A shoe/binding assembly for a snow gliding board, said assembly comprising:

at least one attachment means fixed to the binding for interacting with at least one complementary attachment means fixed on the shoe at front and rear portions thereof;

an attachment point between the attachment means of the shoe and the attachment means of the binding having a plurality of locking positions for locking the attachment means of the shoe to the attachment means of the binding, thereby prohibiting any movement of the shoe upward;

said attachment means on the binding comprising a first locking lever, and the complementary attachment means on the shoe comprising a notched region into which said first locking lever locks, said first locking lever associated with a return element which presses it directly into contact with said notched region, wherein said assembly is automatically adjusted from one locking position to the next in the downward direction of the shoe when subjected to a downward force.

2. The shoe/binding assembly of claim 1 wherein the notched region includes a plurality of teeth which are oriented upward and are connected by inclined portions which allow the first locking lever to move upward.

3. The shoe/binding assembly of claim 1 wherein the binding further comprises a rear frame adapted to rise over the lower leg of the user.

4. The shoe/binding assembly of claim 3 wherein said frame is adjustable in position in the longitudinal direction of the binding.

5. The shoe/binding assembly of claim 3 wherein the frame includes a spoiler mounted in articulated engagement with a stirrup piece.

6. The shoe/binding assembly of claim 5 wherein the spoiler has a second locking lever for locking said spoiler in position on said stirrup piece.

7. The shoe/binding assembly of claim 6 wherein the second locking lever is articulated with respect to the spoiler at an axle for articulation of the second locking lever relative to the spoiler.

8. The shoe/binding assembly of claim 6 wherein the second locking lever is adjustable in order to adjust the inclination of the spoiler relative to the stirrup piece.

9. The shoe/binding assembly of claim 1 wherein the number of attachment means corresponding to attachment points between the shoe and the binding is three.

10. The shoe/binding assembly of claim 9 wherein two of said attachment means are adapted to be located level with the metatarsophalangeal joint of the foot of the user, and the third attachment means is adapted to be located behind the Achilles tendon/calf region of the user.

11. The shoe/binding assembly of claim 10 wherein said two attachment means on the binding include hooks and the complementary attachment means on the shoe include pins which engage said hooks.

12. The shoe/binding assembly of claim 10 wherein said two attachment means on the binding are adjustable in position in the transverse and longitudinal directions.

13. The shoe/binding assembly of claim 12 further including a frame which is adjustable in position in the longitudinal direction of the binding, and further comprising means for coupling the positional adjustments of said two attachment means and of said frame.

14. The shoe/binding assembly of claim 1 wherein the binding includes a plate for accommodating the sole of the shoe, said plate including an upper face having inclined slopes wherein said plate facilitates expulsion of a wedge of snow formed between the shoe and the binding.

15. A shoe/binding assembly for a snow gliding board, said assembly comprising:

at least one attachment means fixed to the binding for interacting with at least one complementary attachment means fixed on the shoe at front and rear portions thereof;

an attachment point between the attachment means of the shoe and the attachment means of the binding having a plurality of locking positions for locking the attachment means of the shoe to the attachment means of the binding, thereby prohibiting any movement of the shoe upward;

said attachment means on the binding comprising a first locking lever having a notched region, and said complementary attachment means on the shoe comprising a pin into which said first locking lever locks, said first locking lever being associated with a return element which presses it directly into contact with said pin, wherein said assembly is automatically adjusted from one locking position to the next in the downward direction of the shoe when subjected to a downward force.

16. The shoe/binding assembly of claim 15 wherein said attachment point is located at the rear of the shoe.

17. The shoe/binding assembly of claim 15 wherein the notched region includes a plurality of teeth which are oriented upward and are connected by inclined portions which allow the first locking lever to move upward.

18. The shoe/binding assembly of claim 15 wherein the binding further comprises a rear frame adapted to rise over the lower leg of the user.

19. The shoe/binding assembly of claim 18 wherein said frame is adjustable in position in the longitudinal direction of the binding.

20. The shoe/binding assembly of claim 18 wherein the frame includes a spoiler mounted in articulated engagement with a stirrup piece.

21. The shoe/binding assembly of claim 20 wherein the spoiler has a second locking lever for locking said spoiler in position on said stirrup piece.

22. The shoe/binding assembly of claim 21 wherein the second locking lever is articulated with respect to the spoiler at an axle for articulation of the second locking lever relative to the spoiler.

23. The shoe/binding assembly of claim 21 wherein the second locking lever is adjustable in order to adjust the inclination of the spoiler relative to the stirrup piece.

24. The shoe/binding assembly of claim 15 wherein the number of attachment means corresponding to attachment points between the shoe and the binding is three.

25. The shoe/binding assembly of claim 24 wherein two of said attachment means are adapted to be located level with the metatarsophalangeal joint of the foot of the user, and the third attachment means is adapted to be located behind the Achilles tendon/calf region of the user.

26. The shoe/binding assembly of claim 25 wherein said two attachment means on the binding include hooks and the complementary attachment means on the shoe include pins which engage said hooks.

27. The shoe/binding assembly of claim 26 wherein said two attachment means on the binding are adjustable in position in the transverse and longitudinal directions.

28. The shoe/binding assembly of claim 27 further including a frame which is adjustable in position in the longitudinal direction of the binding, and further comprising means for coupling the positional adjustments of said two attachment means and of said frame.

29. The shoe/binding assembly of claim 15 wherein the binding includes a plate for accommodating the sole of the shoe, said plate including an upper face having inclined slopes wherein said plate facilitates expulsion of a wedge of snow formed between the shoe and the binding.

* * * * *